US006595718B2

(12) United States Patent
Smith

(10) Patent No.: US 6,595,718 B2
(45) Date of Patent: Jul. 22, 2003

(54) EXO-LIFT

(75) Inventor: William Bruce Smith, Yuba City, CA (US)

(73) Assignee: Works R&D, Inc., Yuba City, CA (US)

( * ) Notice: Subject to any disclaimer, the term of this patent is extended or adjusted under 35 U.S.C. 154(b) by 0 days.

(21) Appl. No.: 09/682,546

(22) Filed: Sep. 19, 2001

(65) Prior Publication Data

US 2003/0053861 A1 Mar. 20, 2003

(51) Int. Cl.[7] ..... E01C 19/52
(52) U.S. Cl. ..... 404/99; 404/73
(58) Field of Search ..... 404/72, 73, 75, 404/83, 90, 99, 100, 34; 299/36.1; E01C 19/52

(56) References Cited

U.S. PATENT DOCUMENTS

| | | | | | |
|---|---|---|---|---|---|
| 910,922 | A | * | 1/1909 | Kerns | 299/36.1 |
| 4,145,153 | A | * | 3/1979 | Fasullo et al. | 404/73 |
| 4,153,301 | A | * | 5/1979 | Armstrong | 299/36.1 |
| 4,194,863 | A | * | 3/1980 | Vansickle et al. | 414/24.5 |
| 4,320,985 | A | * | 3/1982 | Kleinemas | 404/99 |
| 4,583,879 | A | * | 4/1986 | Hofman | 294/104 |
| 4,657,307 | A | * | 4/1987 | Staley et al. | 404/90 |
| 5,037,236 | A | * | 8/1991 | Probst | 404/104 |
| 5,423,137 | A | * | 6/1995 | Cochran | 404/90 |
| 5,755,048 | A | * | 5/1998 | Lee | 404/90 |
| 6,203,242 | B1 | * | 3/2001 | Englund | 404/6 |

FOREIGN PATENT DOCUMENTS

| | | | | | |
|---|---|---|---|---|---|
| DE | 3312416 | A1 | * | 10/1984 | E01C/19/52 |
| DE | 3342072 | A1 | * | 5/1985 | E01C/19/52 |
| DE | 3406854 | A1 | * | 9/1985 | E01C/19/52 |
| DE | 3607463 | A1 | * | 9/1987 | E01C/19/52 |
| DE | 3710837 | A1 | * | 10/1988 | E01C/19/52 |
| DE | 19938521 | A1 | * | 3/2001 | E01C/19/52 |
| EP | 0131133 | A1 | * | 5/1984 | E01C/19/52 |
| EP | 0139827 | | * | 6/1984 | E01C/19/52 |
| EP | 0551828 | A1 | * | 1/1993 | E01C/19/52 |
| GB | 2239475 | A | * | 7/1991 | E01C/19/52 |
| GB | 2279639 | A | * | 1/1995 | E01C/19/52 |
| JP | 01290803 | A | * | 11/1989 | 404/78 |

* cited by examiner

*Primary Examiner*—Robert E. Pezzuto
*Assistant Examiner*—Alexandra K. Pechhold
(74) *Attorney, Agent, or Firm*—Kolisch Hartwell, P.C.

(57) ABSTRACT

A system and method for removing and replacing rigid pavement sections in highways, bridge decks, airport runways, and various other similar structures are provided. The system typically includes a lifting frame which attaches to a damaged slab and is removed with the slab as a unit in a single operation. The frame may also be used to reinstall a replacement slab or panel while acting as external reinforcement. The frame may also serve to align the replacement panel in the void left by the removed section while under-bedding material is installed and cured under the new panel. The system may also utilize a unique saw cutting method and joint splicing method which accomplish a completed removal and replacement process which is faster, cheaper, and stronger than prior art methods. The system reduces the downtime required for replacement of transportation system facilities using rigid pavement, which are in need of repair by replacement.

6 Claims, 7 Drawing Sheets

EXO-LIFT

BACKGROUND OF INVENTION

In the rigid pavement industry, concrete failures often occur in isolated areas. In the past, saw-cutting failed slabs in multiple smaller sections and then individually removing these sub-sections separately accomplished removal of these damaged slabs. This has become known as the "non-impact" method of removal. An alternative to this "non-impact" method is known as the "impact method" in which an air compressor-powered jackhammer mounted on a backhoe is used to "rubble-ize" the damaged slab. This rubble must then be removed, and the underlying base must be repaired before the replacement slab can be installed, costing more time and money. The non-impact method spares the structural integrity of the base layer of the rigid pavement, while the impact method destroys the structural soundness of the base material. The non-impact method is preferred due to the added labor, cost and time of repairing the damaged base material when the impact method is used.

At this point the concrete is placed, finished and cured. Depending on the type of concrete used, curing could require hours to days before reaching design strength and being put back into service. Because the economic cost of stopping vehicular or aircraft traffic, and the inconvenience to the public in shutting down the transportation system, choices had to be made between closing lanes of highways or airport landing fields for long periods of time or, alternatively, using very expensive concrete products which cure in a few hours. These fast setting concretes can be so sensitive and unpredictable that they sometimes set up while still in the transit mix truck; or if certain conditions change slightly they can take 12 hours to set up instead of the usual four to six hours. Another great concern is that if the repair location is more than a short haul distance from a concrete production plant fast-setting concrete mixes were infeasible because of their short set times. One alternative is to set up portable batch plants for on-site preparation of fast-setting concrete, but additional costs are associated with this operation. For these reasons, this method of repair is extremely expensive and problematical.

An alternative to the fast-setting concrete method is to place pre-cast slabs into the holes from which the damaged panels were removed. Then an expanding foam injection process raises the new panel into position. Both methods (fast-setting concrete or pre-cast panels) have saved time, also saving effort, while allowing the repairs to be done in an eight hour shift in the middle of the night, or at a time when the highway, runway, or bridge can be closed or partially shut down. Because of the expense of fabricating and hauling pre-cast panels to the site and using the expensive expanding foam agents, the latter method proved more expensive than using fast-setting concrete but less problematical.

SUMMARY OF INVENTION

This novel invention solves many of the problems of the prior art methods of removing and replacing damaged rigid pavement sections.

The novelty of this invention is in the way it is used to remove, and replace various rigid pavements, in particular, the concrete used in highways and runways at airports. This invention utilizes an external framing (thus "exo" as in "exo-skeletal"), a structural frame to remove broken concrete slabs as single units, and replace the same with new panels. It further acts to externally reinforce the new panels during lifting and aligning in position. It maintains structural support for the replacement slab during its final placement and connection to adjacent slabs, structures, and various other items depending on its application. Support is also maintained while the replacement slab is being bedded and anchored in cementitious or other properly chosen fast-setting materials.

Initially, using a novel tilted guide platform for mounting the concrete saw at a small angle to the perpendicular modifies the saw-cutting process. This allows the concrete joint to be double sawn, once vertically and once at a small angle, to give the concrete slab being removed a beveled edge, which allows it to be removed in a vertical direction without binding to and possibly damaging the rigid concrete pavement to remain. This provides significant savings in time and monetary cost.

After saw cutting around the area to be replaced, the invention is placed over the area of the broken-up concrete. Because it is important to preserve the integrity of the layer just below the concrete layer (which is typically aggregate base, cement treated base, asphalt base, Lean concrete or some similar base material), the broken pieces of slab are individually drilled for anchor installations. The new invention is adjustable both in width and length to accommodate any configuration of cracks in the damaged pavement. Once the frame is bolted to the broken slab, the slab can be removed as a single unit by crane. This saves much time and allows the unit to be hauled off the site and out of the way quickly and efficiently. This invention can save an estimated 10 to 60 percent of the usual time over the current demolition and piecemeal removal methods. The base material is essentially undisturbed, alleviating the need to repair it and thus saving more time and money.

The new invention allows the choice of manufacturing pre-cast replacement panels efficiently at a pre-cast yard. The invention could be attached to these panels at the site of manufacture to facilitate their transportation to the job site. Alternatively, the replacement slabs can be cast at or near the job site. Since the invention reduces the moment loading of the replacement slabs during lifting, transport and installation, it is no longer necessary to include internal steel reinforcement in their manufacture to enable them to withstand the stresses of shipping, lifting, and installation (which are much greater than the stresses encountered during the actual traffic loading of the slab), thus saving time and monetary expense.

Now the slab with the frame attached can be crane lifted into place, where it is aligned with the pavement surrounding it by the extensions of the longitudinal and transverse beams. The replacement slab will also be supported so that it can leave a small void under the new slab. This void produces the prism for the new base support layer, which can be filled with a very small amount of fast-setting grout. The grout can be mixed at the site with no transit mix trucks required. Only 5 to 10 percent of the original volume of the slab would be required to be replaced with this fast setting material. Because of the small volume of materials required, bagged products would become economically feasible for use. (Bagged products being those whose performance and specifications are documented, proven and generally accepted in the industry as acceptable for use in applications similar to the present application.) The use of these "bagged products" opens the door to remote use of this method where only a small mixing drum is necessary to mix products which have a much higher level of quality control inherent in their production. Costs ranging several orders above the fast setting concrete mixes are still economic and actually preferable because there is no question as to material consistency and the water addition is observable at the site by the inspector. Products do not need to be hauled, so much "hotter" mixes—those that set much faster—can be used without problems occurring such as might be encountered with a ready-mix truck hauling over a distance, or a delay occurring in unloading a truck. Such delays sometimes cause the mix to set up in the truck before it gets unloaded. This is known to happen, and it increases costs significantly. It also increases down time, causing major problems for the facility users. When hotter mixes can be used without these problems, lane closure or runway down time can be dramatically reduced. Because the material under the slab would only need to meet a small percentage of the strength of materials which were used to support the surface load, the time before which loading could be allowed would be significantly shortened. Once the grout underlying the new slab reached initial set and achieved adequate compressive strength, the present invention frame can be unbolted and removed and traffic loading could be resumed.

The grout can be pumped into the low side of the slab edge and will fill upward forcing out air bubbles. As the void below the slab is filled it also fills any irregularities in the base surface providing a uniformly supported replacement slab. As the grout continues to be pumped it rises to fill the voids where the rebar-to-slab splices are, and then finally the joints surrounding the replacement slab are filled to a level just below the surface. Immediately after the initial set the joints can be topped off to be flush with the adjoining surfaces. All that is left is to remove the Exo-Lift frame and fill the connection holes with the same grout. Within minutes the replacement slab will be able to accept traffic loading.

The Exo-Lift frame is completely collapsible into single beam sections that can typically be lifted, maneuvered and bolted in place by a two-person crew, without the use of equipment. The present invention saves both time and money over the prior art methods.

This invention advances the state of the art and science of removing, manufacturing, transporting, installing, and anchoring of concrete or other composition slabs. This opens the doors to meeting the needs of transportation, on the ground and in the air, assisting engineers in overcoming many of the problems they are facing and those, which shall become much greater. The exo-skeletal novelty opens doors, affecting many applications on virtually all fronts, including, but not limited to: Slab construction and materials; Transportation; Installation Methods; Novel connection methods; Handling; Removal; Economy; Safety; Downtime; Inter-slab reinforcement (Doweling—load transferring).

DETAILED DESCRIPTION

Figure 1A:
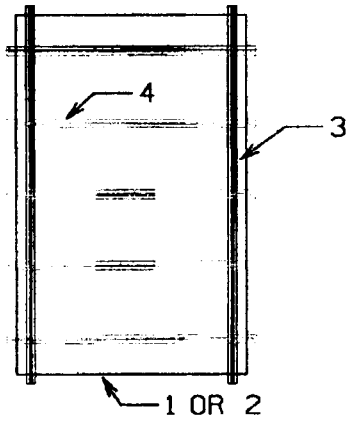
FIGS. 1A through 1E are plan views showing various possible configurations of longitudinal lower frame beams crossed by transverse upper frame beams, both overlying an existing saw cut portion of rigid pavement to be removed, or alternately overlying the replacement panel joint outline.
Figure 1B:
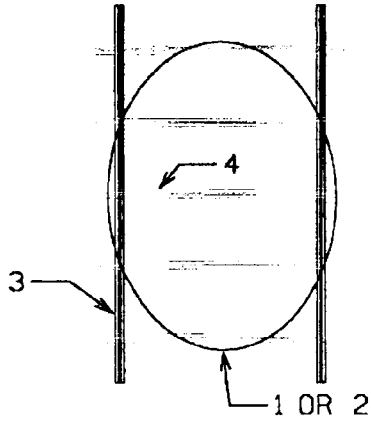
Figure 1C:
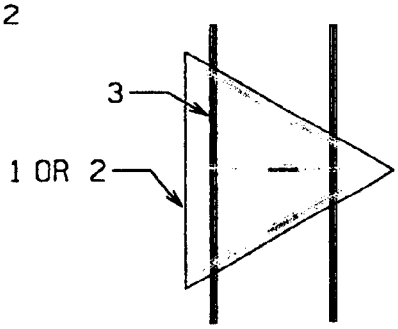
Figure 1D:
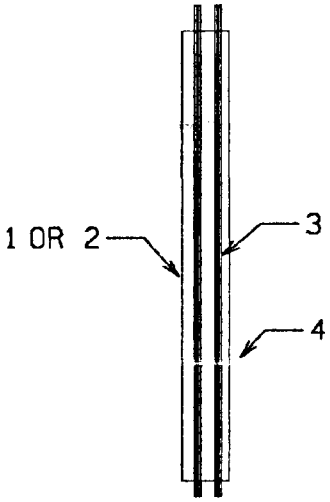
Figure 1E:
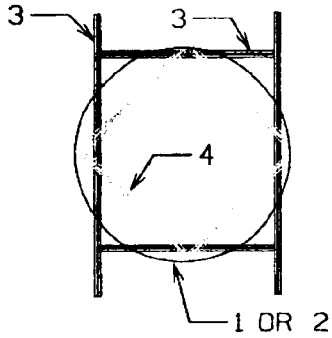

Referring to FIG. 1A Through FIG. 1E upper beams 4 and lower beams 3 comprise the basic Exo-Lift Frame that is adjustable and configurable in various shapes and sizes. Virtually any shape can be accounted for using the normal pinned connection detailed in FIG. 6. FIG. 1A would be a typical shape, which may also be encountered, in a skewed condition in some highway pavements. This is easily accounted for by simply changing the pinning locations in the beams. FIG. 1B Depicts the System as applied to curved shapes where the Exo-Lift Frame simply overlaps the section to be removed. FIGS. 1C and 1D are further examples of adaptability to length to width proportioning and shape considerations. FIG. 1E uses longitudinal and transverse lower beams 3 in combination with rotated upper beams 4. This large degree of freedom of shape size and location of beam placement relative to the outer perimeter 1 (also shown as the joint 2 of the new section) of the section being removed is important in that when failed or broken slabs are removed it must be possible to get an anchor into any give point of the existing pavement so that any and all sections can be attached to the Ex-Lift Frame so that a single removal operation will lift out 100% of the broken pavement. Beams 3 and 4 can be of any material although double steel channels are used in this depiction and member sizes will vary depending on sizes and depth of rigid pavement. Pinned connection are used to facilitate breaking down the Exo-lift Frame into multiple parts which can be lifted by two men and loaded on a truck without necessity for wide loads. The frame could be welded or bolted or connected in whatever fashion is most suitable to the material and application. Thus the double steel channels disclosed hereinafter are not to be interpreted as unnecessarily limiting.

Figure 1F:
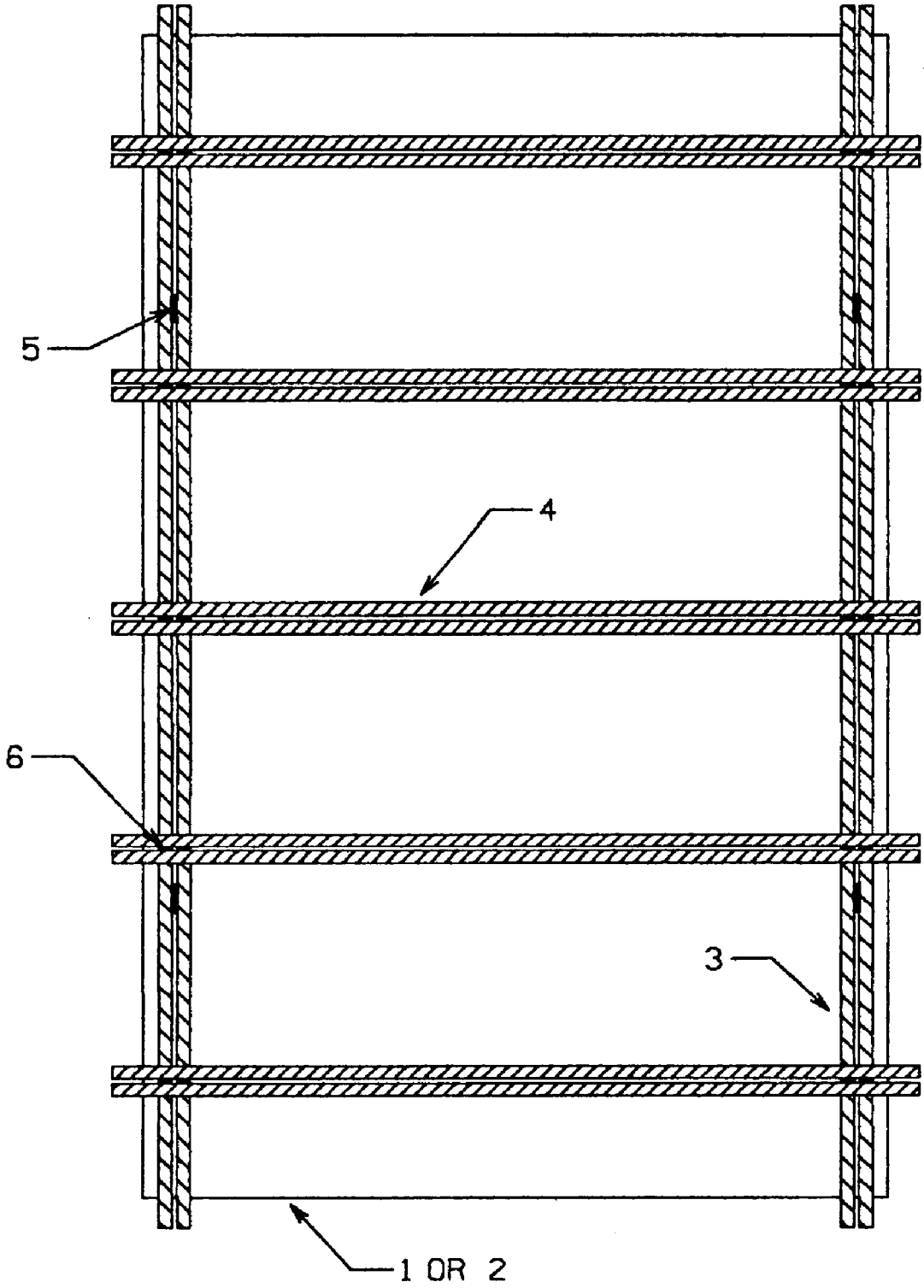
FIG. 1F is a plan view depicting the configuration shown in FIG. 1A enlarged to show the detail of spacers between doubled up steel channels and the lifting lugs between the doubled steel channels.
Figure 6:
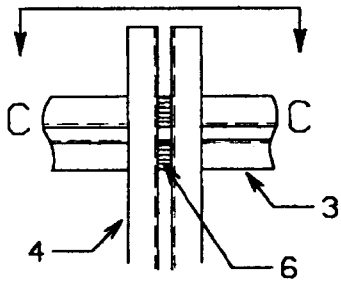
FIG. 6 is an enlarged top view of the intersection of upper and lower beams along with a section view showing the pinned connection between upper and lower beams 3 and 4.
Figure 7:
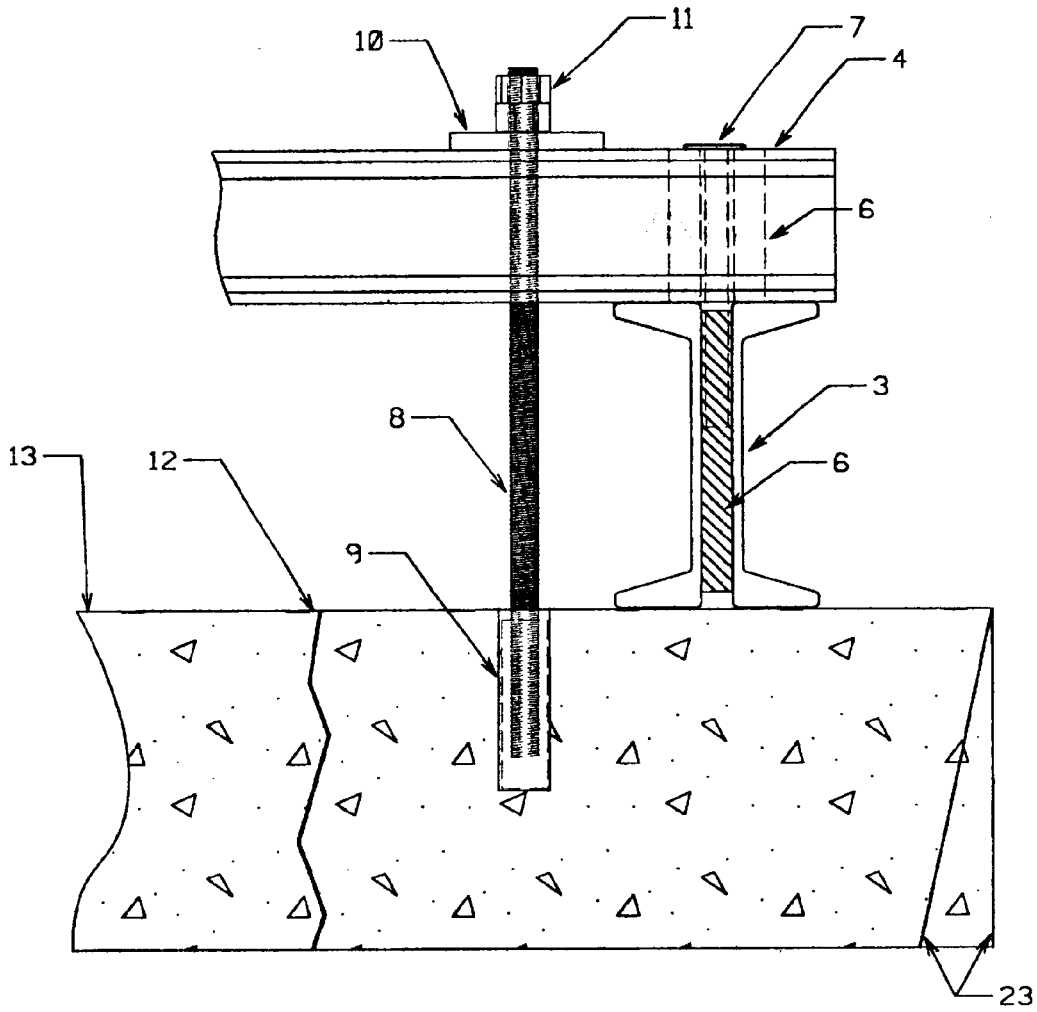
FIG. 7 is a section through an existing broken slab 13 with the Exo-Lift Frame system attached to that slab set up for removal. This view also depicts the beveled saw cut 23.
Figure 8:
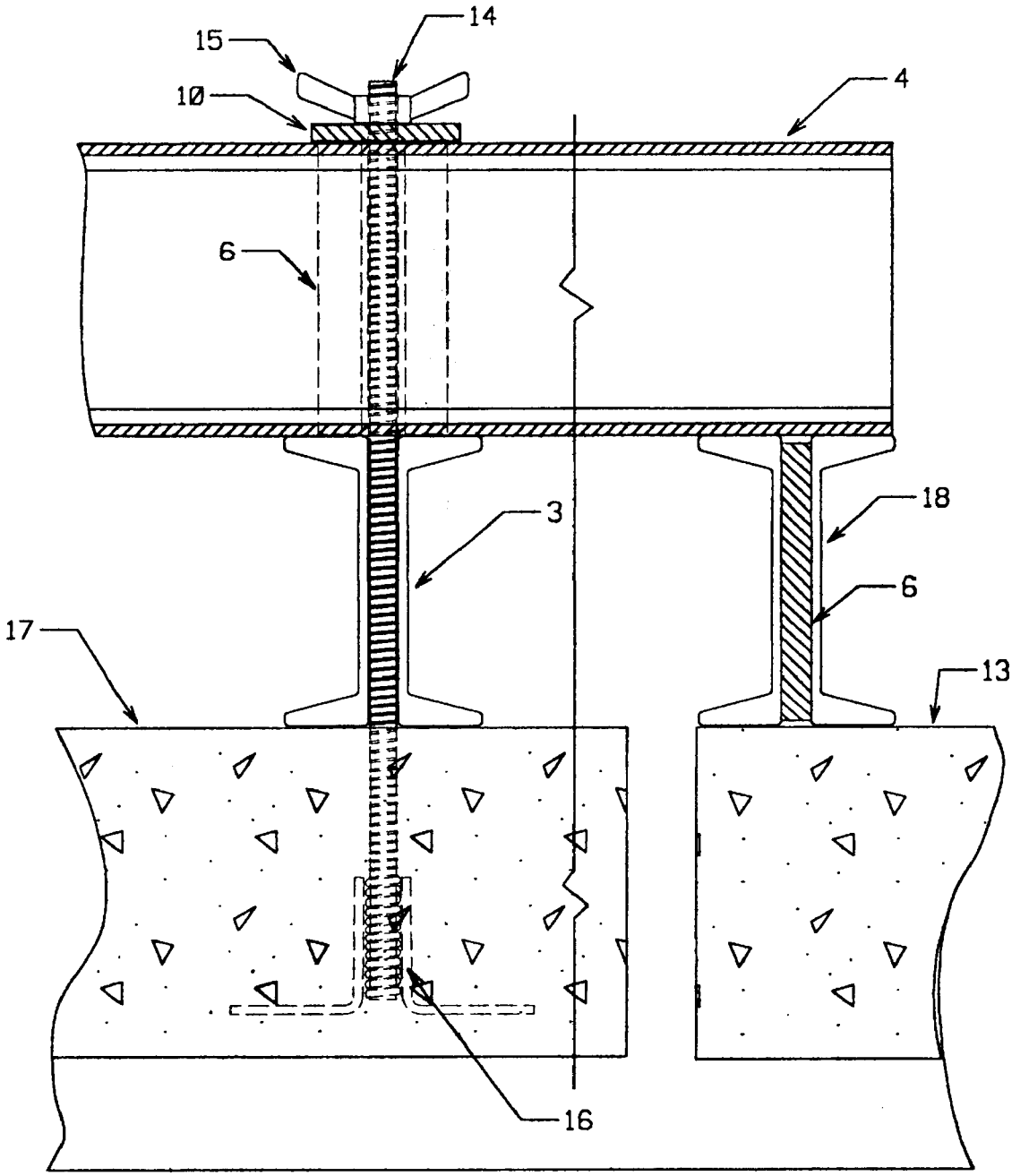
FIG. 8 is a section view through the existing rigid pavement, shown on the right side of the joint and the replacement slab shown on the left, with the Exo-Lift Frame system set up for installation. This view also depicts the support beam block 18 placed under the upper beam.

Referring to FIG. 1F depicts both conditions of slab removal and installation. For Slab removal the lower beams 3 are moved out toward the edge of the slab to increase the area to which attachments cam be made. (This is the configuration shown). For slab installation the beams would be move inward to help minimize the moment when lifting un-reinforced slabs (during installation attachments go through both beams 3 and 4 at fewer connection points than during removal. Upper Beams 4 are shown perpendicular to and bearing on lower beams 3. Spacers 6 are used between the double steel channels at intervals to provide a continuous slot along the length of both beams 3 and 4 so that access to pinning upper and lower beams can be done at any position along the length of the beams. This continuous slot also provides the ability to make an attachment as shown in FIG. 7 anywhere within the perimeter of the section being replaced. These spacers 6 are also used at intervals to connect the doubled steel channels. The spacers can be welded in place to both channels. At the intersection of beams 3 and 4 shown in FIG. 6 the spacers 6, when used as a unit of two with the same interval between them as their thickness form a square tube through the beams 3 and 4 and when these are lined up the tube formed supplies the barrel into which the pin connector 7, also seen in FIG. 6, is inserted into, which locks the beams in position. In FIG. 8 the coil rod 14 actually goes through the barrel formed by the groups of spacers 6, also locking the beams in position.

Referring still to FIG. 1 the lifting lugs 5 are welded into place between the double steel channels that form beams 3. The lifting lugs 5 are placed along the length of both beam 3 left and beam 3 right. The lugs are placed so that when the Exo-Lift is lifted using the lugs that the resulting moment in the slab is minimized by the support gained in the moment carrying capacity of the beams. Quarter points in the length of the slab probably produce this result best but conditions can vary with shape. No matter where the fractures are in the slab being removed the Exo-Lift can be attached to all pieces.

Figure 2:
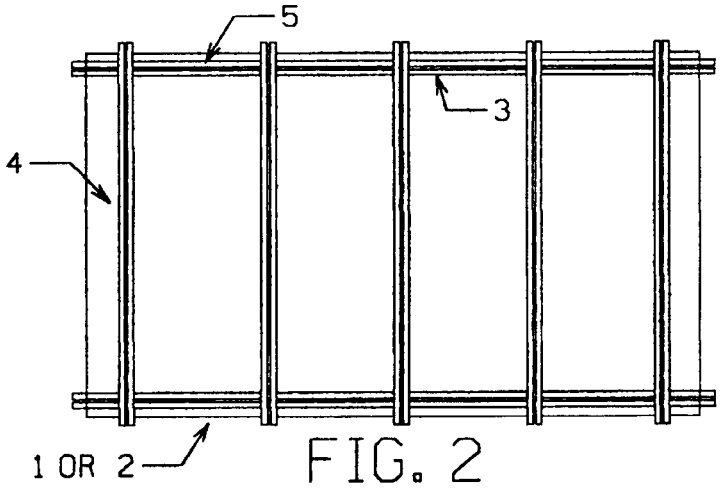
FIGS. 2, 3, and 4 are FIG. 1 shown in plan, side and end views respectively.
Figure 4:
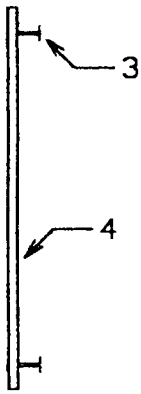
Figure 3:
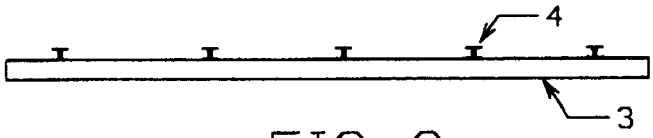

Referring to FIGS. 2, 3, and 4 top view, side view, and end view respectively. These views are shown only to help clearly represent relative positions of beams 3, 4 in the other dimension.

Figure 5:
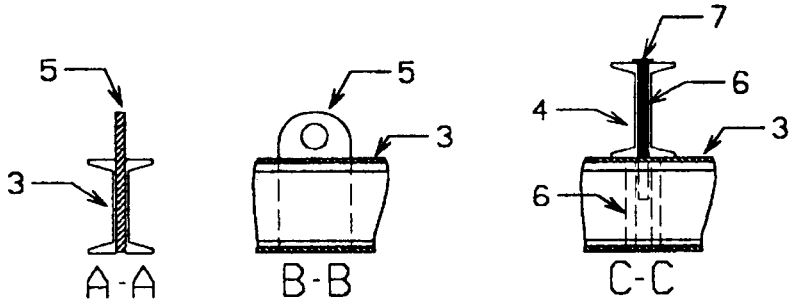
FIG. 5 is an enlarged top view of 3 at the lifting lug 5 along including a section and elevations at lifting lug 5.
Figure 5:
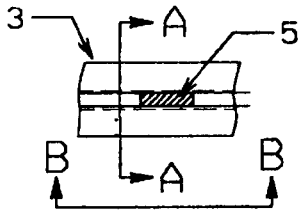

Referring to FIG. 5 lifting lug 5 is welded at all contact points between both of the steel channels composing beam 3. The lug 5 protrudes above the beam to allow easy connection of crane rigging or forklift brackets to these points.

Referring to FIG. 6 as described earlier the dually installed spacers form a convenient barrel for either the pin connector 7 (during the removal process) or the Coil Rod 14 (during installation process) to be installed through which gives the beams support allowing them to lock in place when the frame is loaded while lifting for removal or installation.

Figure 10:
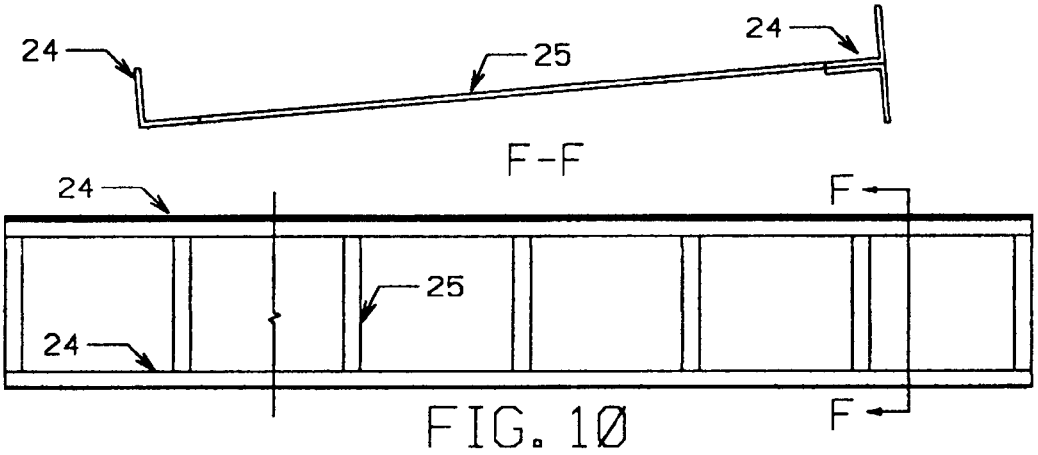
FIG. 10 is a top view and a section view of a guide rail to be used to set the concrete saw at an angle so that the beveled saw cut 23 can be made in FIG. 7.

Referring to FIG. 7 represents the Exo-lift in the removal mode. Important to note are saw cuts in section 23 which are made prior to slab removal These cuts are facilitated with the use of the concrete saw guide shown in FIG. 10 which allows the saw to be operated at an inclined angle. These saw cuts are made around the entire perimeter of the slab to be removed. The beveled saw cut produced using the saw cutting guide frame is necessary to keep the slab from binding when removed. Slab binding could add undue strain on lifting equipment and could also damage adjacent slab edges thus requiring more repair and added cost. With the beveled saw cut the broken slab pieces are easily removed as a single unit. In the removal process the concrete anchors 9 are installed with a minimum of one in each separate broken piece of slab. After the anchors are set the beams 3 and 4 can be placed such that all anchors are directly under some portion of beam. Connector pins 7 and either all thread 8 (as shown) or coil rod 14 can be inserted and using plate washer 10 and nuts 11 or 15 the attachment can be tightened down. The combination of connector pins and attachment devices pulling down create forces on the beams 3 and 4, which naturally lock all parts into position. At this point the slab can be rigged to crane, fork lift of various other pieces of equipment and removed—as a single unit. The unit can be placed on a truck and removed out of the work zone and the installation process can now begin.

Figure 11:
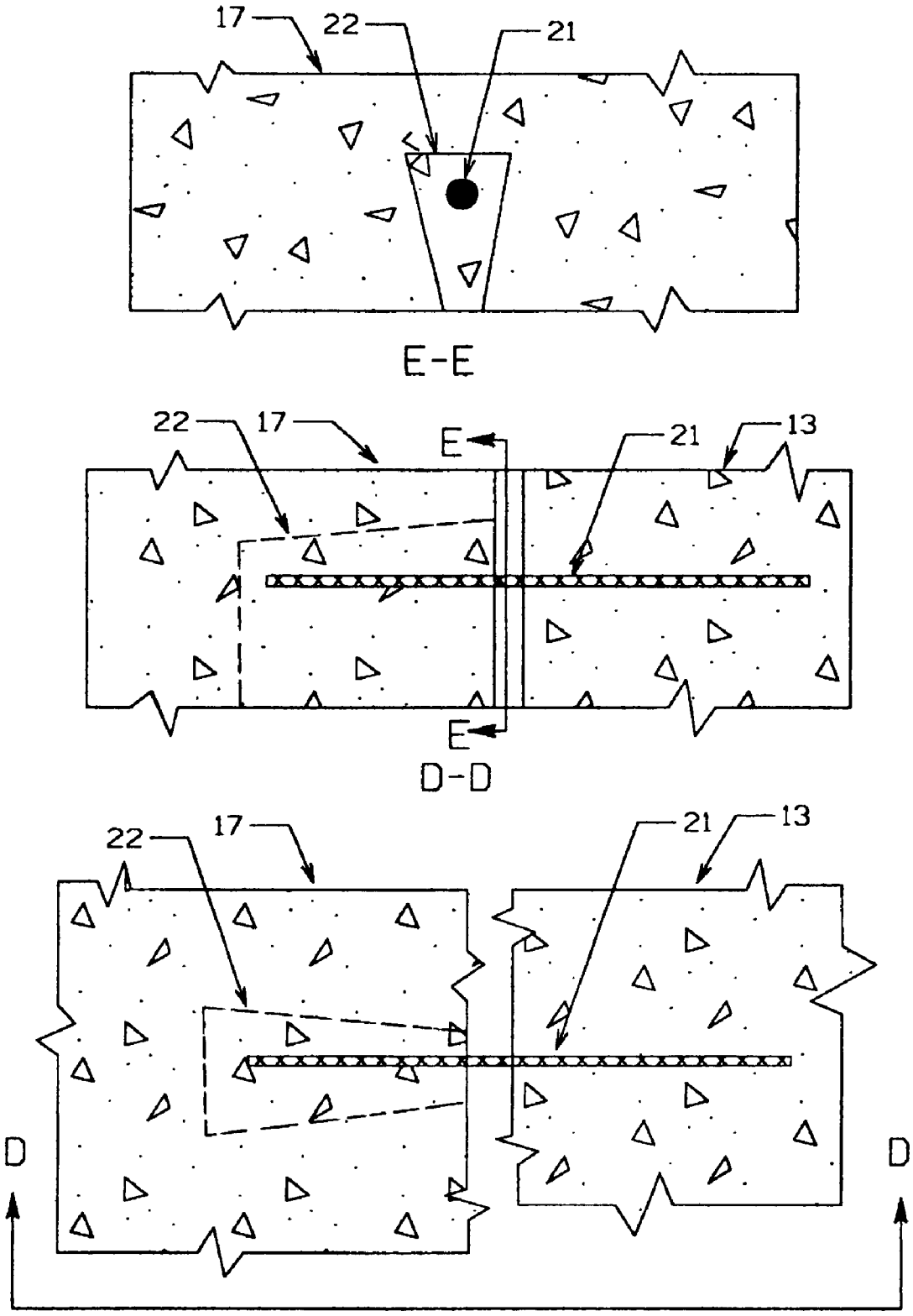
FIG. 11 is a plan view of the joint 2 at the reinforcement steel with two sections taken one transversely and one longitudinally. These three views show the reinforcement connection dowel and the reduction block-out used to make the connection between the existing and replacement rigid pavements.

Many rigid pavement designs call for steel reinforcement between adjacent slabs and many do not. This next phase is unnecessary with ones that are not tied together. If inter-slab reinforcement is necessary the following work is necessary. Referring to FIG. 11 which is a plan view of new joint with a transverse section D—D and a longitudinal section E—E. These section are taken at a reinforcement tie which uses a reinforcement connection dowel 21. A hole is drilled into the existing slab 13 at a spacing that will coincide with reduction cavity block-out 22 locations in the new replacement slab sections 17 (typically 2 foot spacing). The reinforcement dowel can be slipped into the hole or can be secured in the hole with epoxy at a depth approximately one half its length (typically six to twelve inches). The reduction cavity block-outs 22 are critically shaped as shown for two reasons. The upper portion is sloped upward and outward so that when under bedding and joint filing material 19 is pumped in (see next operation in the following paragraph), starting at the bottom, the air will be forced out and no bubbles will be left which would weaken the connection. In the plan view of FIG. 11 the sides of the reduction cavity block-out 22 are skewed to the reinforcement causing the joint filing material to be trapped into the block-out when hardened and resisting slab separation, when required by joint design, relying on not only bonding of the joint material with the new slab but also on mechanical interlocking to resist this separation. In section E—E the sides of the reduction cavity block-out are also skewed for the same reason to cause the reinforcement to be mechanically interlocked into the reduction cavity block-out. The shape is critical as mentioned above for the high strength which is necessary in this connection which: (1) resists slab separation (alternate joint designs vary on requirement to resist separation—transverse joints often do not resist separation and use a smooth slip dowel), (2) resists differential settlement, (3) resists longitudinal movement of the joint, (4) transfers load and strengthens slab perimeter condition. Now that the reinforcement connection dowel is secured we are ready to place the new replacement slab section.

Referring to FIG. 8 which is a transverse section through a joint between the existing rigid pavement on the left and the replacement slab on the left the Exo-Lift frame system is shown attached to the new slab and holding it in final position in the void created by the removed section. The frame comprised of upper and lower beams 4 and 3 is attached to the slab through the use of a cast in place coil rod embedded anchor 16 and a coil rod 14 which goes up through the continuous slots in beams 3 and 4 and also goes through a plate washer 10. This attachment assembly is tightened down with a coil rod wing not 15. A minimum of four of these attachments are necessary, per slab, however more may be used to lower the load at each point of connection and also to reduce the moment that the new slab (which may be either reinforced or non-reinforced by rebar) will experience. The lower beams 3, in this case run longitudinal to the greatest dimension of the slab and are set back in from the right slab edge in this view so that they are one fourth of the narrower dimension of the slab from the edge. This positioning when coupled with the other beam on the opposite side of the slab will balance the load and minimize moment forces in the slab. More attachments can be made along the beam 4 also, to further minimize the moment forces. If the new slab were literally hung in place, centered in the opening one forth of the load of the slab would bear on each end of each of the lower beams 3. For the majority of slabs this will work, however for longer slabs the load will need to be distributed so that the slab does not tend to bow in the center. A support beam block 18 can be placed at locations as necessary to support the load, using beam 4. These intermediate supports, which are placed on opposing ends of the upper beam 4, also align the mid-span of the slab with adjoining surfaces. The overall effect of this Exo-Lift frame support is to align and support in place the slab after the frame has been used to lift and move the slab into position. Throughout the lifting, moving and placing of the slab the moment in the slab has been kept to a minimum. Now that the slab is in its final place and held securely by its own weight.

Figure 9:
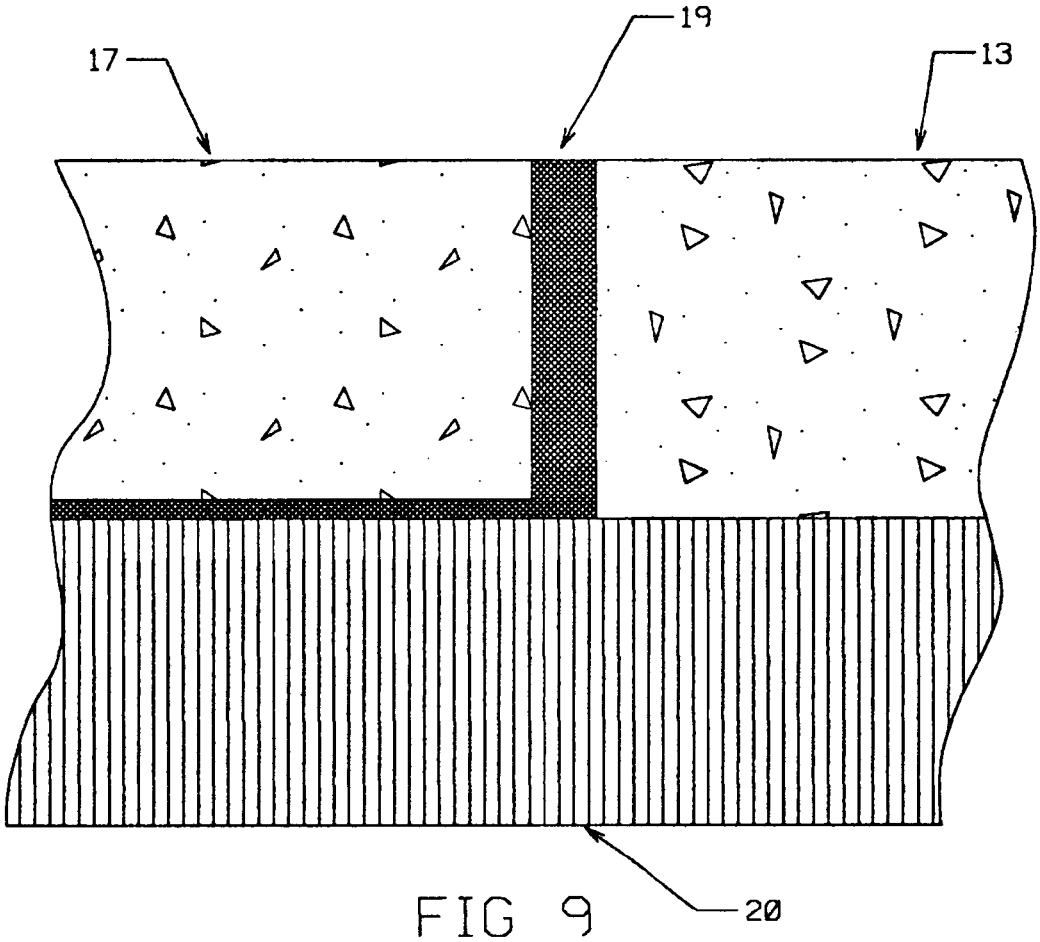
FIG. 9 is a section view through the replaced section at the joint between existing and new rigid pavement with the under bedding and joint filling material shown.

Referring to FIG. 9 the under bedding and joint filling material 19 can now be placed. The under bedding joint filling material can be one of many materials however a non-shrink, fast setting, "bagged product" (prepackaged in specific proportions where quality control is high and the material can be mixed on site in a small mixer with no quality control problems) is desirable for ease of quality control and better efficiency with short pot life products. As is noticeable in the section view of FIG. 9 the new slab 17 is slightly thinner than the existing rigid pavement 13. This is done to ensure that the base material 20 is not detrimentally affected by the replacement operation. The new slab material can be produced of higher strength material to make up for this smaller dimension or the strength of the under bedding material can also be produced to be significantly stronger than the original material thereby the net effect is actually greater inherent strength in the replacement slab sections than in the original rigid pavement being replaced. Starting on the low side the slab 17 the under bedding material can be pumped or funneled into the joint where is will rise naturally to the high side pushing out any air (this is critical to ensure 100% contact bearing with the base 20). Next the joints can be filled with a lower slump mixture of the same material. Now in about the time the it takes to remove broken slabs with current practice methods the replacement slab is ready to have the Exo-Lift frame removed within minutes and the slab can be put back into service very quickly depending on the projected loads and how hot of a mix (fast setting) was used to under bed and fill the joints.

While the examples of the different configurations of use for the Exo-Lift device described with reference to the accompanying drawings have met the objective of the present invention, it will be appreciated by those skilled in the art that many alterations and additions can be made without departing from the scope of the invention as defined by the following claims. For example, it is not essential that the beams be steel or even C-channels, or that the beams be stacked rather than welded in the same plane, or that bolting the beams rather than welding or pinning them is outside the scope of the current invention. Likewise devices for lifting the Exo-Lift frame could be other than crane or fork lift. They could be placed with jacks and casters, mobile trailers, or various other means. A number of alternative bedding base materials, which would satisfy constraints of individual projects, could be employed without departing from the scope of the invention.

What is claimed is:

1. A system for supporting a concrete pavement slab for movement, the pavement slab having a substantially planar upper surface, the system comprising:

a plurality of anchors configured to be embedded within the slab, each of the anchors extending the from the substantially planar upper surface of the slab into an interior of the slab;

a frame configured to be positioned adjacent the substantially planar upper surface of the slab such that a portion of the frame is positioned adjacent each of the anchors; and a plurality of attachment assemblies, each attachment assembly configured to securely connect one of the anchors to a corresponding portion of the frame, to thereby secure the frame to the slab;

wherein, upon securing the frame to the slab, the frame is configured to be lifted upward as a unit with the concrete pavement slab during transport, without gripping the slab from the side.

2. The system of claim 1, wherein the frame is configured to be positioned external to the concrete slab.

3. The system of claim 1, wherein the frame includes beam members.

4. The system of claim 3, wherein the position of the beam members are adjustable relative to each other such that at least a portion of one beam member may be positioned adjacent each of the anchors when the frame is positioned adjacent the concrete slab.

5. The system of claim 4, wherein the beam members include transverse beam members and longitudinal beam members.

6. A system for removing a concrete slab broken into a plurality of sections, the system comprising:

a frame having adjustabie frame members configured to be positioned adjacent the slab such that a portion of at least one of the frame members is positioned adjacent each of the plurality of sections of broken concrete slab;

a plurality of attachment devices attaching the frame members to each of the broken sections, each attachment device being securely embedded within a broken section of the slab, thereby securing the frame to the broken slab, such that the frame supports the broken concrete slab as a whole and inhibits movement of the broken sections when the frame and slab are lifted as an upward unit.

* * * * *